US007607991B2

(12) United States Patent
Sorenson

(10) Patent No.: US 7,607,991 B2
(45) Date of Patent: Oct. 27, 2009

(54) GOLF PUTTER AND PUTTER HEAD

(75) Inventor: James W. Sorenson, Mt. Pleasant, IA (US)

(73) Assignee: Momentus Golf, Mount Pleasant, IA (US)

( * ) Notice: Subject to any disclaimer, the term of this patent is extended or adjusted under 35 U.S.C. 154(b) by 808 days.

(21) Appl. No.: 10/998,909

(22) Filed: Nov. 29, 2004

(65) Prior Publication Data

US 2006/0116216 A1 Jun. 1, 2006

(51) Int. Cl.
*A63B 53/02* (2006.01)

(52) U.S. Cl. ..... 473/313; 473/314; 473/325; 473/328; 473/340

(58) Field of Classification Search ..... 473/246, 473/248, 249, 251–256, 293, 294, 305, 313, 473/324, 314, 340, 341, 345, 410, 558, 559
See application file for complete search history.

(56) References Cited

U.S. PATENT DOCUMENTS

| | | | | |
|---|---|---|---|---|
| 3,448,981 | A * | 6/1969 | Anweiler | 473/314 |
| 4,138,117 | A | 2/1979 | Dalton | |
| 4,141,556 | A * | 2/1979 | Paulin | 473/253 |
| D284,600 | S | 7/1986 | Burgess | |
| 4,754,976 | A | 7/1988 | Pelz | |
| 4,871,174 | A * | 10/1989 | Kobayashi | 473/252 |
| 4,872,683 | A | 10/1989 | Doran et al. | |
| 4,964,639 | A | 10/1990 | Tucker | |
| 4,988,107 | A | 1/1991 | Sasse | |
| 5,046,740 | A | 9/1991 | D'Eath | |
| 5,080,365 | A | 1/1992 | Winchell | |
| D324,250 | S | 2/1992 | Magness | |
| 5,160,141 | A | 11/1992 | Crews | |
| D331,611 | S | 12/1992 | Gebhardt | |
| 5,211,401 | A | 5/1993 | Hainey | |
| 5,344,141 | A | 9/1994 | Smith | |
| D354,535 | S | 1/1995 | Queen | |
| D360,670 | S | 7/1995 | Nilsson | |
| 5,470,068 | A | 11/1995 | Schmidt et al. | |
| 5,494,282 | A | 2/1996 | Pranio | |
| 5,544,879 | A | 8/1996 | Collins | |
| 5,630,766 | A | 5/1997 | Granelli | |
| 5,759,114 | A | 6/1998 | Bluto et al. | |
| 5,785,608 | A | 7/1998 | Collins | |
| D404,095 | S | 1/1999 | Gedeon | |
| 5,890,969 | A | 4/1999 | Bechler | |
| 5,947,837 | A | 9/1999 | Perry | |
| 6,039,657 | A * | 3/2000 | Gidney | 473/252 |
| D422,328 | S | 4/2000 | Lannoch | |
| 6,045,453 | A | 4/2000 | Jenkins | |

(Continued)

*Primary Examiner*—William M Pierce
(74) *Attorney, Agent, or Firm*—Schwegman, Lundberg & Woessner P.A.

(57) ABSTRACT

A putter club head has a longitudinal body and a means of attaching a shaft thereto. The body may be solid, hollow, or partially hollow or solid. If hollow or partially hollow, the body may have a weighted mass therein. Such a weighted mass may be located towards a front section of the club head near a ball striking surface. The means to attach a shaft is located in the rear section of said body in proximity to the distal end of the rear section of said body. The shaft may curve and bend so that it is oriented near the center of the body and towards a golfer addressing a golf ball.

34 Claims, 7 Drawing Sheets

U.S. PATENT DOCUMENTS

| | | | | |
|---|---|---|---|---|
| 6,048,275 | A | 4/2000 | Gedeon | |
| 6,068,560 | A | 5/2000 | DeLuca | |
| D429,296 | S | 8/2000 | Franzen | |
| 6,176,791 | B1 | 1/2001 | Wright | |
| 6,203,446 | B1 | 3/2001 | Collins | |
| 6,267,689 | B1 | 7/2001 | Ambrose | |
| D448,437 | S | 9/2001 | Colucci | |
| D454,933 | S | 3/2002 | Shenoha | |
| D455,467 | S | 4/2002 | Shenoha | |
| 6,406,380 | B1 | 6/2002 | Jackson | |
| 6,471,600 | B2 | 10/2002 | Tang et al. | |
| 6,616,545 | B2 | 9/2003 | Lacoste | |
| D481,431 | S | 10/2003 | Wightman | |
| 6,679,782 | B2 | 1/2004 | Tang et al. | |
| 6,716,110 | B1 | 4/2004 | Ballow | |
| 6,767,292 | B1 | 7/2004 | Skalla, Sr. | |
| 6,767,293 | B2 | 7/2004 | Pechter | |
| 6,958,019 | B2 * | 10/2005 | Rohrer | 473/324 |
| 6,962,537 | B2 * | 11/2005 | Johnson | 473/313 |
| 7,004,849 | B2 * | 2/2006 | Cameron | 473/249 |
| 7,070,515 | B1 * | 7/2006 | Liu | 473/340 |
| 7,086,957 | B2 * | 8/2006 | Solheim et al. | 473/251 |
| 2002/0115498 | A1 | 8/2002 | Galliers | |
| 2003/0228925 | A1 | 12/2003 | Rohrer | |
| 2004/0173964 | A1 | 9/2004 | Pollman | |

* cited by examiner

GOLF PUTTER AND PUTTER HEAD

FIELD OF THE INVENTION

The present invention relates to golf equipment, and in particular, an improved putter and putter head.

BACKGROUND OF THE INVENTION

Since the early beginnings of the game several hundred years ago, golfers have been looking to the technological advancement of golf clubs and other equipment to play a better game and lower their scores. As evidenced by one popular aphorism on the golf course—"Drive for show, putt for dough"—a golfer's putting game is crucial to his efforts to lower his score. However, technological advances in putters have not kept pace with the advances in other types of golf clubs. This is illustrated by the fact that many golfers, including some professionals such as Phil Mickelson, still use the basic blade putter or some variant thereof. The art is therefore in need of a novel putter that will aide a golfer in his putting game, and consequently lower his score.

SUMMARY OF EMBODIMENTS

In one or more embodiments of the present invention, a golf putter has a club head and a shaft attached thereto. The club head has a longitudinal body, a ball striking surface, and a hole, slot or other receptacle as a means to receive the shaft. In some embodiments, the body is hollow, in other embodiments it is solid, and in still other embodiments, it is partially hollow and partially solid. In the embodiments that are neither completely hollow nor completely solid, a weighted or solid mass is preferably positioned adjacent to or towards the ball striking surface. The shaft is connected to the putter club head at the rear portion of the putter, that is, distal from the striking surface of the putter. In at least one embodiment, the shaft is bent in one or more locations so that a major length of the shaft is substantially centered over the body. The body, the weighted mass (if the body is not substantially hollow or substantially solid), the attachment of the shaft in the rear, and the bend of the shaft to center the major length of the shaft over the body, all contribute to a golfer's ability to execute a finely tuned putting stroke, with crisper ball contact and a resulting truer line and path of a putt.

DETAILED DESCRIPTION OF EMBODIMENTS

Figure 1A:
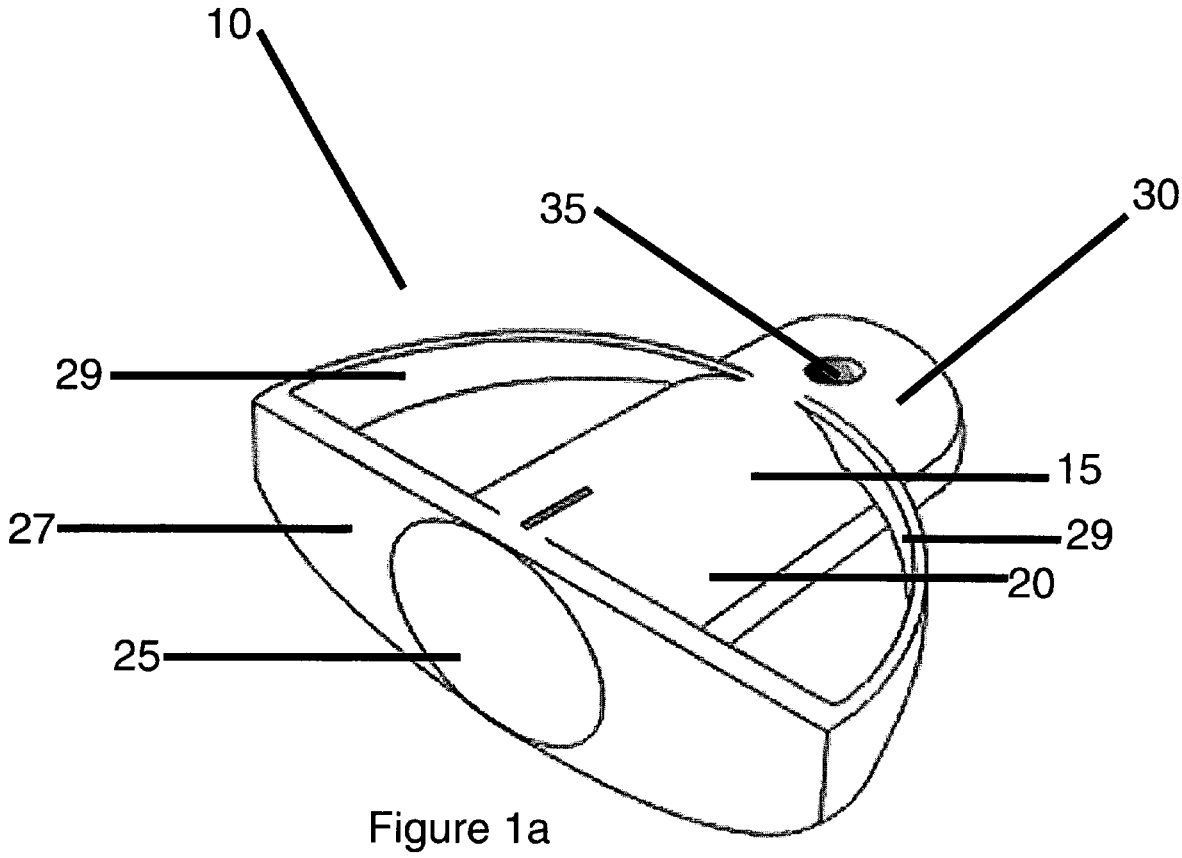
FIG. 1*a* illustrates a front perspective view of an embodiment of a putter head of the invention.
Figure 1B:
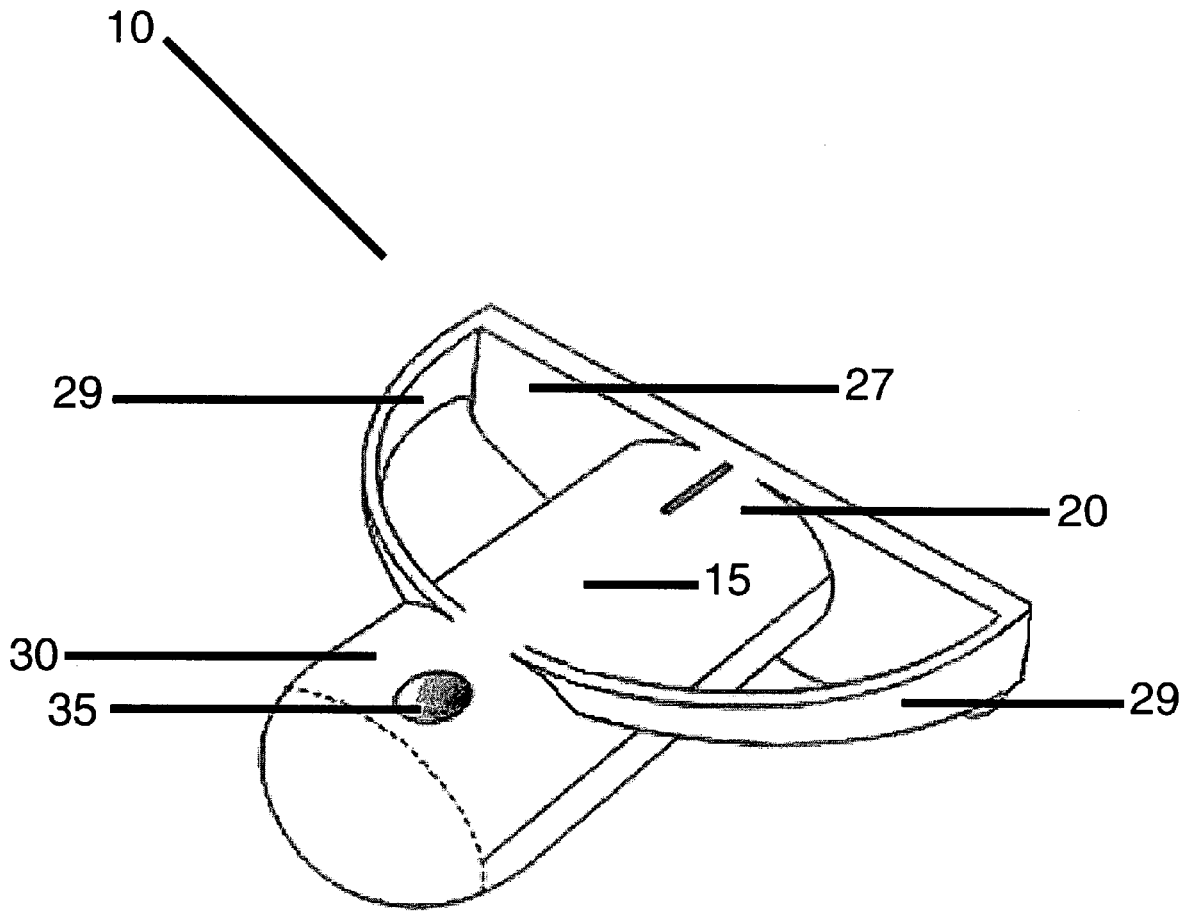
FIG. 1*b* illustrates a rear perspective view of an embodiment of a putter head of the invention.
Figure 2:
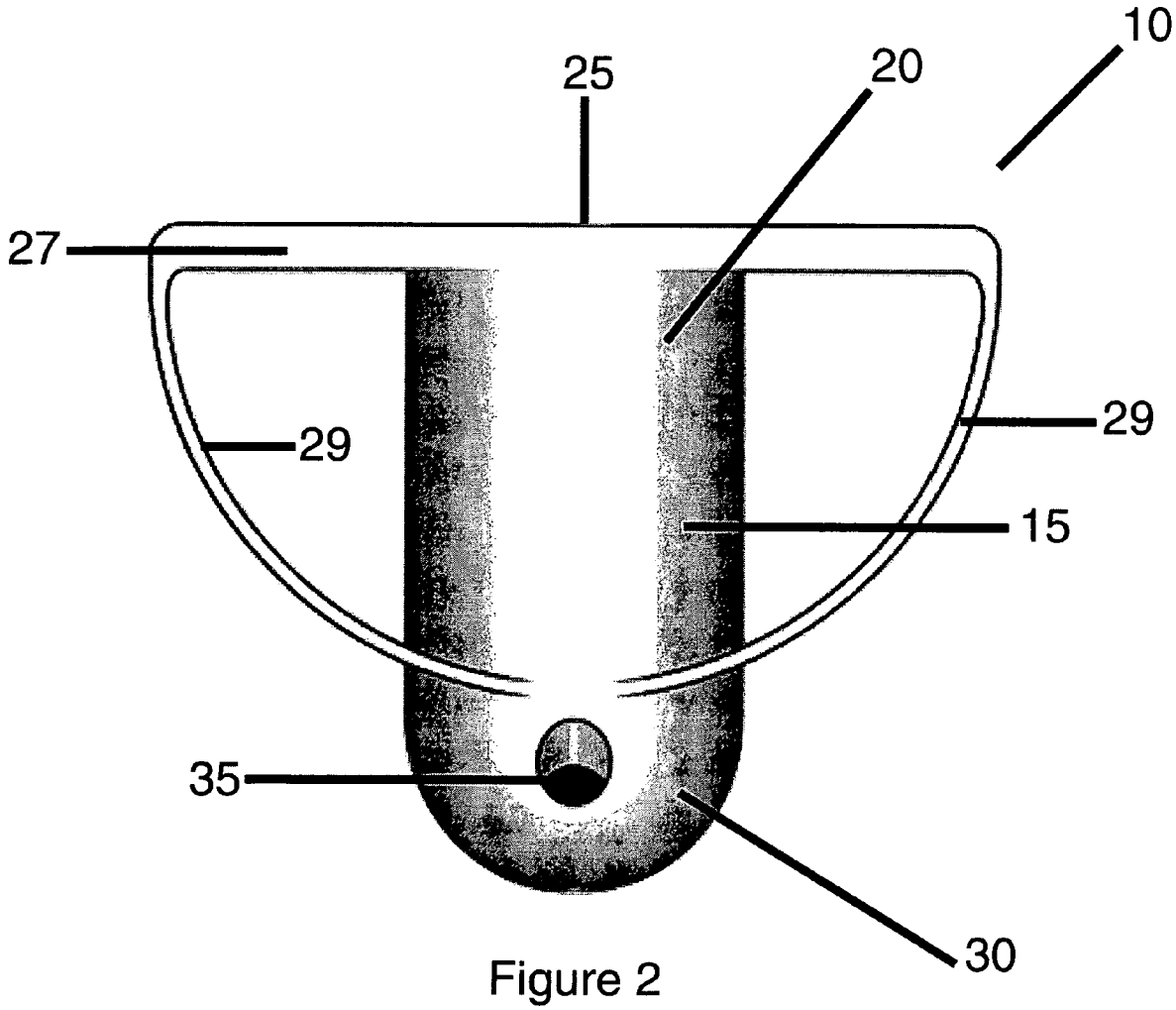
FIG. 2 illustrates a top planar view of an embodiment of a putter head of the invention.
Figure 3:
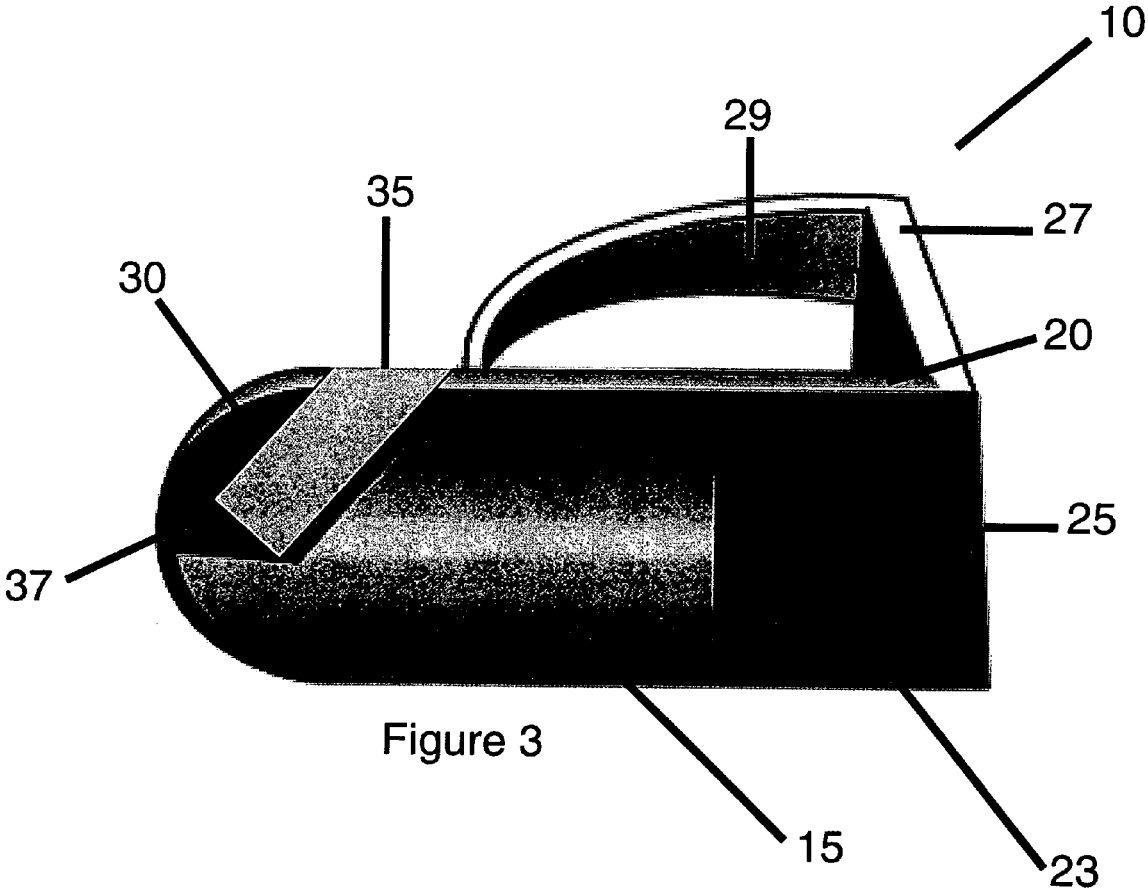
FIG. 3 illustrates a perspective longitudinal sectional view of an embodiment of a putter head of the invention.

Referring to FIGS. 1, 2, and 3, an embodiment of a putter club head of the present invention is illustrated. Specifically, putter head 10 has a longitudinal body 15 consisting of a front segment 20 and a rear segment 30. The body 15 may be constructed out of one or more of several metals and/or alloys that are well known in the art such as aluminum, steel, brass, lead and tungsten. In this particular embodiment, the body 15 is predominantly hollow. In embodiments in which the body 15 is substantially hollow, the thickness of the walls of the body 15 surrounding the hollow portion is approximately 5 mm. As illustrated in FIGS. 1, 2, and 3, a cross section of the body 15 is in the form of an oval, but other shapes, such as a circle, square or rectangle, are also workable. Additionally, the rear segment 30 in FIGS. 1, 2 and 3 is rounded or semi-spherical in shape. The precise shape of the rear segment 30 however is not critical to the functioning of the putter, and other shapes and configurations will work also. Moreover, even though the rear segment 30 may be rounded, the majority of the bottom surface of the body 15 is flat, and when placed onto a flat surface, will lie flush with that flat surface. The front segment 20 has a flat surface 25 that serves as a ball striking surface, or receives and secures another component—blade 27—that serves as a ball striking surface.

Figure 4:
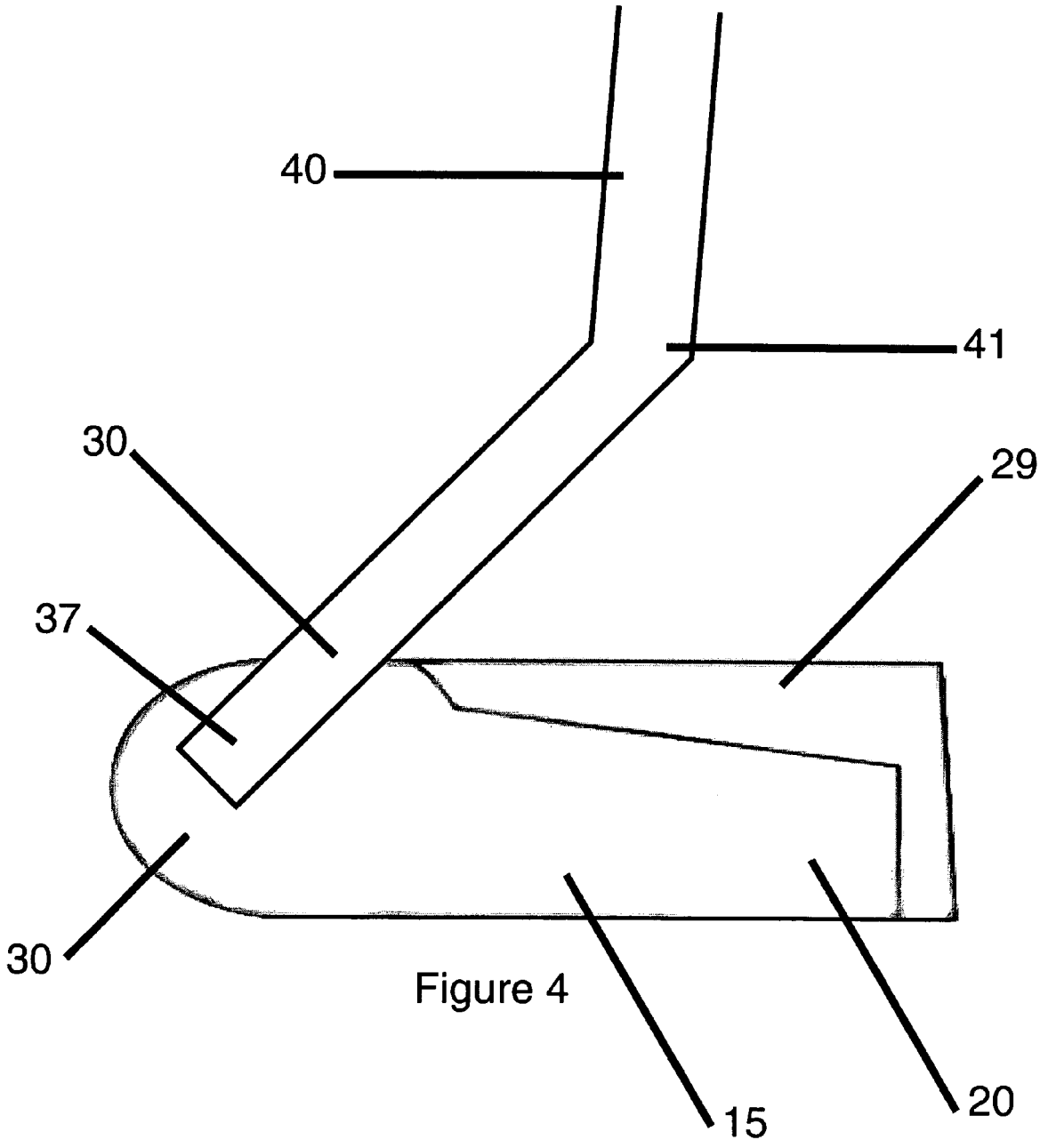
FIG. 4 illustrates a side view of an embodiment of a putter head of the invention in combination with a shaft.
Figure 5:
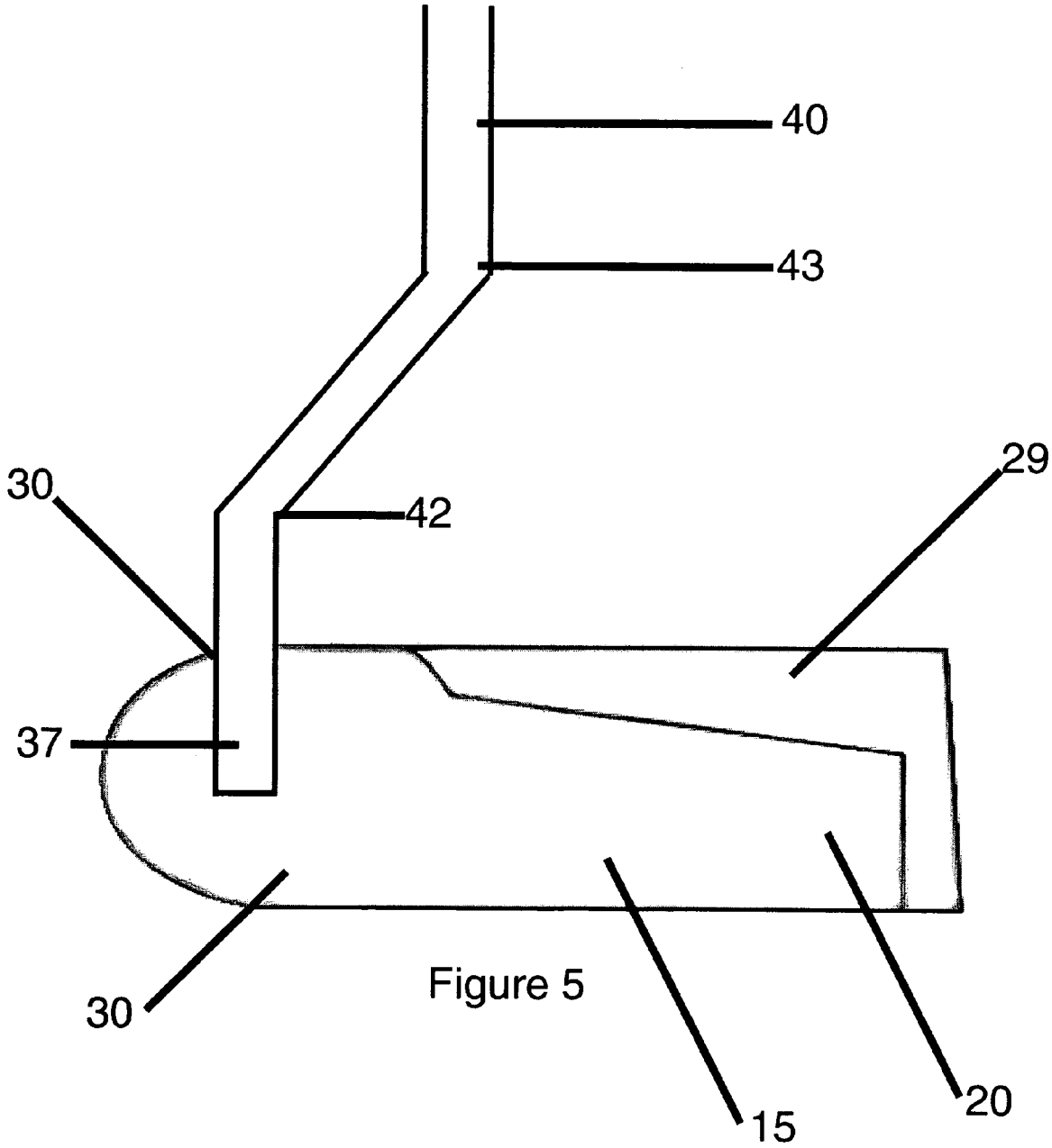
FIG. 5 illustrates a side view of another embodiment of a putter head of the invention in combination with a shaft.

In the embodiment of FIGS. 1, 2 and 3, the rear segment 30 has a hole 35 that serves as an opening for a tubular passageway 37 that serves as a means to receive a shaft 40. (See FIGS. 4 and 5). Other embodiments may have other means, such as a slot, to receive the shaft 40. In still other embodiments, the means is a protuberant shaft that is positioned on the body 15, and a hosel or other connector that joins the protuberant shaft with the shaft 40. The hole 35 and tubular passageway 37 have a central axis that may be oriented perpendicularly to a horizontal axis of the body 15, or at angles divergent from the perpendicular. One of skill in the art will realize that through the orientation of the hole 35, passageway 37, and bends or curves along the length of the shaft 40, the shaft may be positioned perpendicular to a horizontal axis of the body 15 virtually anywhere along the length of the body 15—i.e. at front segment 20, at rear segment 30, or somewhere between the front segment 20 and rear segment 30. Furthermore, the hole 35 and passageway 37 may be placed in positions other than at the rear segment 30 of the body 15. In a preferred embodiment however, the hole 35 and passageway 37 are positioned in the body 15 towards the rear segment 30, and the major length of the shaft 40 is positioned substantially over the center of the body 15. In such a preferred embodiment, to position the majority of the shaft 40 over the center of the body 15 when the hole 35 and passageway 37 are towards the rear segment 30, the hole 35 and passageway 37 may be angled towards the front segment 20 of the body 15 at an angle of approximately 30° from vertical as shown in FIG. 4. Then, at a point that is substantially centered over the body 15, a bend 41 in the shaft 40 orients the major length of the shaft perpendicularly with the center axis of the body 15, and towards a lateral side of the body 15 so that the shaft leans toward a golfer for gripping. In another embodiment, the shaft 40 can attach to a putter head 10 via a hole 35 and tubular passageway 37 that are substantially perpendicular to a horizontal axis of the putter head. In such an embodiment, a bend 42 in the shaft 40 positions the shaft over the body at the desired longitudinal location, and a second bend 43 positions the shaft to rise vertically towards a golfer for ease of grasp by the golfer. See FIG. 5. The second bend 43 in the shaft not only directs the shaft in a line perpendicular to a horizontal axis of the body 15, but also directs the shaft towards a lateral side of said body and towards a golfer addressing a golf ball.

FIG. 3 further illustrates a weighted mass 23 within the front segment 20. The weighted mass 23 may be manufactured out of the same metal or alloy as the body 15, or it may be manufactured out of a different metal or alloy of the same, greater, or lesser density than the body 15. The weighted mass 23 may also be integrally formed into the body 15 of the putter head. In a preferred embodiment, the weighted mass is a solid mass, and it is positioned directly behind and adjacent to the ball striking surface 25. In other embodiments, the weighted mass 23 may not be solid, but may for example consist of two or more adjacent plates. Also in other embodiments, the weighted mass may not be adjacent to the striking surface 25, but in close proximity to the striking surface. Additionally, the weighted mass 23 need not be uniformly distributed from the top of the body 15 to the bottom of the body 15 as shown in FIG. 3. Rather, other configurations are possible wherein the weighted mass 23 occupies only a top or bottom portion of the body 15.

FIGS. 1, 2, and 3 further illustrate a blade 27 attached to the front segment 20 of the body 15. In a preferred embodiment, the blade 27 is a separate piece from the body 15 and is attached and secured to the front segment of the body 15 by means well known in the art such as by welding, soldering, or the use of an appropriate adhesive. In another embodiment, the blade 27 may be made as an integral part of the body through molding, casting, or some other process known in the art. The length of the blade 27 should be approximately the length of a typical putter head ball striking surface as is known in the art, i.e. approximately 10 cm. Consequently, in the above-described preferred embodiment, both the length of the body 15 and the length of the blade 27 are approximately 10 cm.

The putter head 10 of the present invention encompasses embodiments not only in which the weighted mass 23 is adjacent to the striking surface 25, but embodiments in which the weighted mass 23 is substantially towards the front segment 20 of the body 15. Embodiments of the present invention also include weighted masses 23 of different lengths, thicknesses, and materials. For example, in one embodiment, the body 15 is approximately 9.5 cm in length. With a body length of 9.5 cm, a preferred length of the weighted mass 23 would be approximately 2.4 cm and would be adjacent to the striking surface 25. However, the weighted mass 23 of a body 15 of length 9.5 cm could be as short in length as approximately 0.5 cm, and in one embodiment could range up to the entire length of the body. It is preferred that the weighted mass 23, or the solid mass of the body 15, be positioned substantially forward of the hole 35. In another embodiment, the length of the body is approximately 8.6 cm. For a body length of approximately 8.6 cm, a preferred length of the weighted mass 23 would be approximately 2.2 cm in length, but could be as short in length as approximately 0.4 cm, and in one embodiment could range up to the entire length of the body 15. In practice, the length of the body 15 can range from approximately 6.4 cm to 10.8 cm, with the entire spectrum of weighted masses placed therein. While the weighted mass 23 can range from a very short segment to the entire length of the body, it is preferred that it occupy approximately 25% of the length of the body.

FIGS. 1, 2 and 3 further illustrate wings 29 that join each end of the flange 27 with a mid-portion of the body 15. It should be noted that the wings 29 do not serve any structural or functional purpose. That is, the functionality, feel, and strength of the putter head 10 will be predominately the same in the presence or absence of the wings 29. This is the case because the body 15 and the blade 27 are manufactured out of a sturdy metal or alloy that needs no further structural support. However, the wings 29 serve two trade dress functions. First, the wings 29 impart to the putter head 10 a unique and source identifying look. Second, the wings 29, when an object such as a golf ball contacts the striking surface 25, emit a unique and source identifying chime. The tone, pitch and/or frequency of the chime can be altered by changing the thickness of the wings 29.

Figure 6:
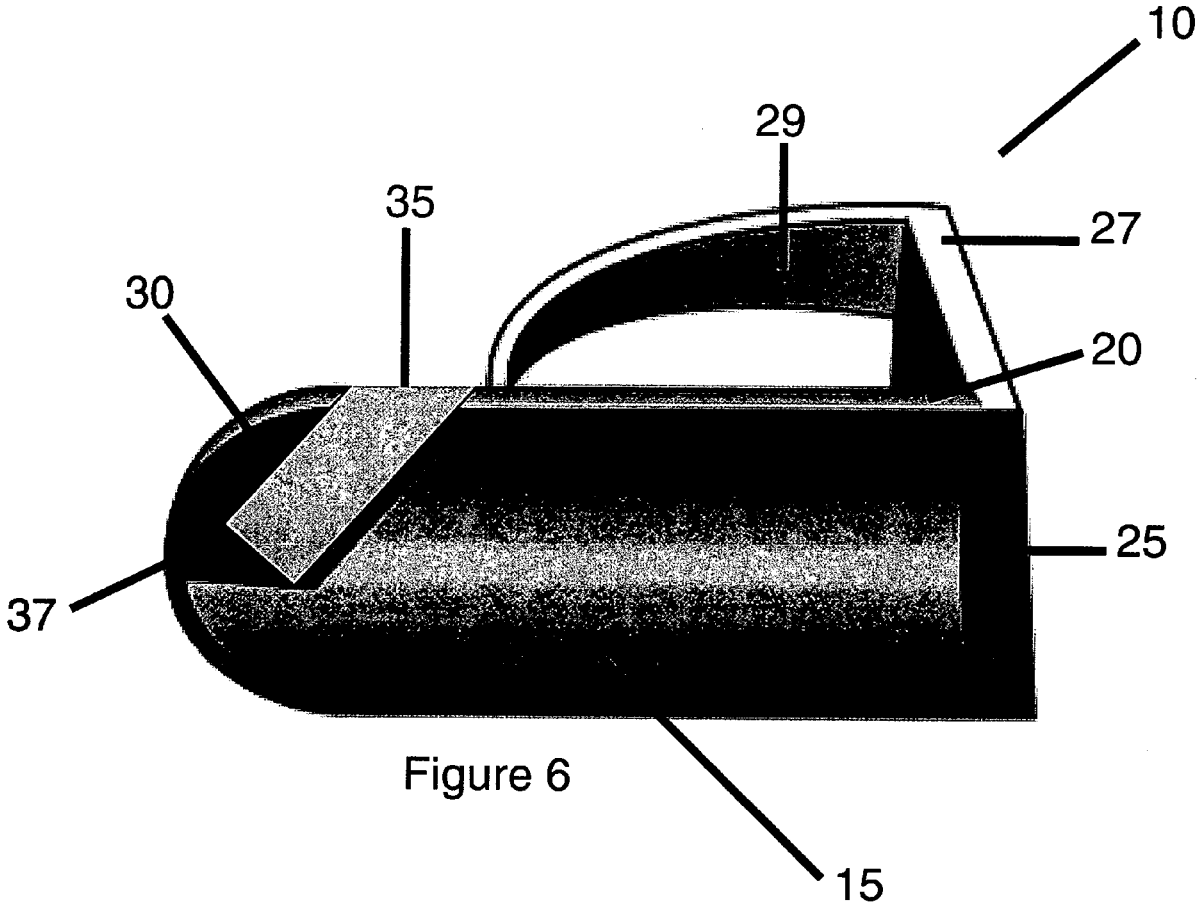
FIG. 6 illustrates a perspective longitudinal sectional view of another embodiment of a putter head of the invention wherein the body of the putter head is substantially hollow and the weight of the putter head is evenly distributed throughout the body wall of the putter head.

Another embodiment of the present invention is illustrated in FIG. 6. In FIG. 6, the longitudinal body 15 of the putter head 10 is substantially hollow as in some of the other above-described embodiments. Also, the body 15 has a front segment 20, a rear segment 30, and a hole, slot or other receptacle 35 as a means to receive a shaft 40. The front segment 20 has attached to it, either integrally or as a separate piece, a blade 27 that serves as the ball striking surface 25. The embodiment of FIG. 6 however lacks a weighted mass 23 as in some of the above-described embodiments. A shaft is attached to the body 15 at hole 35 at the rear segment of body 15, and one or more bends in the shaft substantially center the shaft over the body 15. The embodiment of FIG. 6 does not have the weighted mass for those golfers who prefer the feel of a club head that is lighter. Conversely, the embodiments of the present invention in which the body 15 is completely solid will appeal to golfers who prefer a club head that is heavier. However, whether the body is hollow, partially weighted, or solid, because hole 35 is positioned at the rear segment 30, the weight that is within the body 15 of the club head is positioned between the striking surface 25 and the hole 35.

In Example 1, a golf putter comprises a shaft; a substantially hollow, longitudinal body, said body comprising a front segment, a rear segment, and a horizontal axis; means for receiving said shaft, said means located at an end of said rear segment distal from said front segment; a ball striking surface attached to said front segment; and a weighted mass within said body; wherein a portion of said shaft in proximity to said means for receiving said shaft leans toward said front segment; and further wherein said shaft comprises a first bend directing said shaft towards an axis perpendicular to said horizontal axis and towards a lateral side of said body.

Example 2 includes the golf putter according to Example 1, wherein said weighted mass is positioned between said means for receiving said shaft and said ball striking surface.

Example 3 includes the golf putter according to Example 2, wherein said weighted mass is positioned adjacent to said ball striking surface.

Example 4 includes the golf putter according to Example 2, wherein said weighted mass comprises approximately 1% to 10% of said body by length.

Example 5 includes the golf putter according to Example 2, wherein said weighted mass comprises approximately 11% to 25% of said body by length.

Example 6 includes the golf putter according to Example 2, wherein said weighted mass comprises approximately 26% to 50% of said body by length.

Example 7 includes the golf putter according to Example 2, wherein said weighted mass comprises approximately 51% to 75% of said body by length.

Example 8 includes the golf putter according to Example 2, wherein said weighted mass comprises approximately 76% to 100% of said body by length.

Example 9 includes the golf putter according to Example 1, wherein said means for receiving said shaft is positioned at a distance from said distal end of said rear segment, said distance approximately equal to 5% to 20% of the length of said body.

Example 10 includes the golf putter according to Example 1, wherein said means for receiving said shaft is at least partially within approximately 1 cm to 3 cm of said distal end of said rear segment.

Example 11 includes the golf putter according to Example 1, wherein said means for receiving said shaft comprises a hole and a passageway.

Example 12 includes the golf putter according to Example 1, wherein said body is substantially oval at a cross section perpendicular to the horizontal axis.

Example 13 includes the golf putter according to Example 14, wherein said body lies substantially flat on a surface.

Example 14 includes the golf putter according to Example 1, wherein said means for receiving said shaft is substantially perpendicular to said horizontal axis of said body; wherein said first bend is proximate to said means for receiving said shaft and causes said shaft to lean towards said ball striking surface; and further wherein said shaft comprises a second bend, said second bend orienting said shaft perpendicularly to said horizontal axis, and said second bend further causing said shaft to lean towards a lateral side of said body.

Example 15 includes the golf putter according to Example 1, wherein said first bend substantially centers said shaft over said body.

Example 16 includes the golf putter according to Example 1, wherein said first bend forms an angle of approximately 60 degrees with said horizontal axis.

Example 17 includes the golf putter according to Example 1, wherein said means for receiving a shaft forms an angle of approximately 90 degrees with said horizontal axis, and further wherein said shaft comprises a first bend directing said shaft towards said front segment of said body, and further wherein said shaft comprises a second bend, said second bend directing said shaft towards a perpendicular with said horizontal axis and directing said shaft towards a lateral side of said body.

Example 18 includes the golf putter according to Example 6, wherein said first bend forms an angle of approximately 60 degrees with said horizontal axis, and said second bend forms an angle of approximately 30 degrees with said horizontal axis.

In Example 19, a putter club head comprises a substantially hollow, longitudinal body, said body comprising a front segment, a rear segment, and a horizontal axis; means for receiving a shaft, said means located in proximity to said rear segment; a ball striking surface located in proximity to said front segment; and a weighted mass within said body.

Example 20 includes the putter club head according to Example 19, wherein said weighted mass is located adjacent to said ball striking surface.

Example 21 includes the putter club head according to Example 19, wherein said weighted mass comprises approximately 76% to 100% of said body by length.

Example 22 includes the putter club head according to Example 19, wherein said weighted mass comprises approximately 51% to 75% of said body by length.

Example 23 includes the putter club head according to Example 19, wherein said weighted mass comprises approximately 26% to 50% of said body by length.

Example 24 includes the putter club head according to Example 19, wherein said weighted mass comprises approximately 11% to 25% of said body by length.

Example 25 includes the putter club head according to Example 19, wherein said weighted mass comprises approximately 1% to 10% of said body by length.

Example 26 includes the putter club head according to Example 19, wherein said weighted mass comprises one or more plates, and further wherein said one or more plates are removable from said putter head.

Example 27 includes the putter club head according to Example 19, wherein said body is approximately 9.5 cm in length, and further wherein said weighted mass ranges from approximately 0.5 cm in length to substantially the entire length of said longitudinal body.

Example 28 includes the putter club head according to Example 19, wherein said body is approximately 8.6 cm in length, and further wherein said weighted mass ranges from approximately 0.2 cm in length to substantially the entire length of said longitudinal body.

Example 29 includes the putter club head according to Example 19, wherein said means for receiving a shaft forms an angle of approximately 60 degrees with said horizontal axis.

Example 30 includes the putter club head according to Example 19, wherein said means for receiving a shaft forms an angle of approximately 90 degrees with said horizontal axis.

Example 31 includes the putter club head according to Example 19, wherein said body is substantially oval at a cross section perpendicular to the horizontal axis.

Example 32 includes the putter club head according to Example 19, wherein said body lies substantially flat on a surface.

Example 33 includes the putter club head according to Example 19, wherein said means for receiving said shaft is at least partially within approximately 1 cm to 3 cm of an end of said rear segment distal from said front segment.

In Example 34, a golf putter comprises a shaft; a substantially hollow, longitudinal body, said body comprising a front segment, a rear segment, and a horizontal axis; a hole in said body for receiving said shaft, said hole located in proximity to said rear segment; a ball striking surface located in proximity to said front segment; and a weighted mass within said front segment adjacent to said striking surface; wherein said shaft proximate to said hole forms an angle with said body such that said shaft proximate to said hole leans toward said front segment; wherein said body is substantially oval at a cross section perpendicular to the horizontal axis; and wherein a bend in said shaft orients said shaft perpendicularly to said horizontal axis of said body and towards a lateral side of said body; and further wherein said weighted mass comprises approximately 25% to 35% of said body by length.

While not being bound by theory, and not affecting the scope of coverage of the novel putter and putter head disclosed herein, it is believed that the novel putter and putter head impart several advantages over putters and putter heads of the prior art. First, it is believed that when the weight of the putter head is concentrated near the front portion of the body 15, i.e. adjacent to or very near the striking surface 25 of the putter head, more control, a better feel, and crisper contact between the ball and the club face result. Additionally, it is believed that the putter imparts a truer line to the ball when the majority of the weight of the putter head is positioned directly behind the striking surface. Second, it is believed that a person using a putter equipped with the novel putter head of the present invention has more control over the path of the putter head if the shaft of the putter is substantially centered over the putter head, yet at the same time the point of attachment of the shaft to the putter head is at the rear of the putter head. When the shaft is attached at the rear of the putter head, the weight of the putter head lies between the striking surface 25 and the hole 35. With this set up, the weight of the putter head is pulled more than pushed both during the backstroke and foreswing. For when a golfer moves the putter back in the backstroke, the arms and shoulders of the golfer provide the majority of the force needed to bring the club head back. Hence, with the point of attachment of the shaft serving as the reference point, the weight of the putter head is being pulled back. When a golfer executes the foreswing, gravity plays a larger role in the movement of the club head, and again with the point of attachment of the shaft serving as the reference point, the weight of the club head, which is in front of the shaft attachment point, pulls the club head, the shaft and the golfer's hands and arms forward. Additionally, the longitudinal shape of the body, whether it be oval, circular, square, rectangular, or some other shape, provides a sleek line of travel for the club head during the backstroke and foreswing, and assists the golfer in lining up the proper swing path.

While the invention has been described in its preferred and other embodiments, it is to be understood that the words used are words of description rather than limitation and that changes may be made within the purview of the appended claims without departing from the true scope and spirit of the invention in its broader aspects.

The invention claimed is:

1. A golf putter comprising:

a shaft;

a substantially hollow, longitudinal body, said body comprising a front segment, a rear segment, and a horizontal axis;

means for receiving said shaft, said means located at an end of said rear segment distal from said front segment;

a ball striking surface attached to said front segment; and a weighted mass within said body;

wherein a portion of said shaft in proximity to said means for receiving said shaft leans toward said front segment;

and further wherein said shaft comprises a first bend directing said shaft towards an axis perpendicular to said horizontal axis and towards a lateral side of said body.

2. The golf putter according to claim 1, wherein said weighted mass is positioned between said means for receiving said shaft and said ball striking surface.

3. The golf putter according to claim 2, wherein said weighted mass is positioned adjacent to said ball striking surface.

4. The golf putter according to claim 2, wherein said weighted mass comprises approximately 1% to 10% of said body by length.

5. The golf putter according to claim 2, wherein said weighted mass comprises approximately 11% to 25% of said body by length.

6. The golf putter according to claim 2, wherein said weighted mass comprises approximately 26% to 50% of said body by length.

7. The golf putter according to claim 2, wherein said weighted mass comprises approximately 51% to 75% of said body by length.

8. The golf putter according to claim 2, wherein said weighted mass comprises approximately 76% to 100% of said body by length.

9. The golf putter according to claim 1, wherein said means for receiving said shaft is positioned at a distance from said distal end of said rear segment, said distance approximately equal to 5% to 20% of the length of said body.

10. The golf putter according to claim 1, wherein said means for receiving said shaft is at least partially within approximately 1 cm to 3 cm of said distal end of said rear segment.

11. The golf putter according to claim 1, wherein said means for receiving said shaft comprises a hole and a passageway.

12. The golf putter according to claim 1, wherein said body is substantially oval at a cross section perpendicular to the horizontal axis.

13. The golf putter according to claim 12, wherein said body lies substantially flat on a surface.

14. The golf putter according to claim 1, wherein said means for receiving said shaft is substantially perpendicular to said horizontal axis of said body;

wherein said first bend is proximate to said means for receiving said shaft and causes said shaft to lean towards said ball striking surface; and further wherein said shaft comprises a second bend, said second bend orienting said shaft perpendicularly to said horizontal axis, and said second bend further causing said shaft to lean towards a lateral side of said body.

15. The golf putter according to claim 1, wherein said first bend substantially centers said shaft over said body.

16. The golf putter according to claim 1, wherein said first bend forms an angle of approximately 60 degrees with said horizontal axis.

17. The golf putter according to claim 1, wherein said means for receiving a shaft forms an angle of approximately 90 degrees with said horizontal axis, and further wherein said shaft comprises a first bend directing said shaft towards said front segment of said body, and further wherein said shaft comprises a second bend, said second bend directing said shaft towards a perpendicular with said horizontal axis and directing said shaft towards a lateral side of said body.

18. The golf putter according to claim 14, wherein said first bend forms an angle of approximately 60 degrees with said horizontal axis, and said second bend forms an angle of approximately 30 degrees with said horizontal axis.

19. A putter club head comprising:

a substantially hollow, longitudinal body, said body comprising a front segment, a rear segment, and a horizontal axis;

means for receiving a shaft, said means located in proximity to said rear segment;

a ball striking surface located in proximity to said front segment; and a weighted mass within said body.

20. The putter club head according to claim 19, wherein said weighted mass is located adjacent to said ball striking surface.

21. The putter club head according to claim 19, wherein said weighted mass comprises approximately 76% to 100% of said body by length.

22. The putter club head according to claim 19, wherein said weighted mass comprises approximately 51% to 75% of said body by length.

23. The putter club head according to claim 19, wherein said weighted mass comprises approximately 26% to 50% of said body by length.

24. The putter club head according to claim 19, wherein said weighted mass comprises approximately 11% to 25% of said body by length.

25. The putter club head according to claim 19, wherein said weighted mass comprises approximately 1% to 10% of said body by length.

26. The putter club head according to claim 19, wherein said weighted mass comprises one or more plates, and further wherein said one or more plates are removable from said putter head.

27. The putter club head according to claim 19, wherein said body is approximately 9.5 cm in length, and further wherein said weighted mass ranges from approximately 0.5 cm in length to substantially the entire length of said longitudinal body.

28. The putter club head according to claim 19, wherein said body is approximately 8.6 cm in length, and further wherein said weighted mass ranges from approximately 0.2 cm in length to substantially the entire length of said longitudinal body.

29. The putter club head according to claim 19, wherein said means for receiving a shaft forms an angle of approximately 60 degrees with said horizontal axis.

30. The putter club head according to claim 19, wherein said means for receiving a shaft forms an angle of approximately 90 degrees with said horizontal axis.

31. The putter club head according to claim 19, wherein said body is substantially oval at a cross section perpendicular to the horizontal axis.

32. The putter club head according to claim 19, wherein said body lies substantially flat on a surface.

33. The putter club head according to claim 19, wherein said means for receiving said shaft is at least partially within approximately 1 cm to 3 cm of an end of said rear segment distal from said front segment.

34. A golf putter comprising:

a shaft;

a substantially hollow, longitudinal body, said body comprising a front segment, a rear segment, and a horizontal axis;

a hole in said body for receiving said shaft, said hole located in proximity to said rear segment;

a ball striking surface located in proximity to said front segment; and a weighted mass within said front segment adjacent to said striking surface;

wherein said shaft proximate to said hole forms an angle with said body such that said shaft proximate to said hole leans toward said front segment;

wherein said body is substantially oval at a cross section perpendicular to the horizontal axis;

and wherein a bend in said shaft orients said shaft perpendicularly to said horizontal axis of said body and towards a lateral side of said body; and further wherein said weighted mass comprises approximately 25% to 35% of said body by length.

* * * * *